US010787784B2

(12) United States Patent
Schletzbaum

(10) Patent No.: US 10,787,784 B2
(45) Date of Patent: Sep. 29, 2020

(54) FIELD DRAINAGE SYSTEM AND METHOD

(71) Applicant: Joseph L. Schletzbaum, Atchison, KS (US)

(72) Inventor: Joseph L. Schletzbaum, Atchison, KS (US)

( * ) Notice: Subject to any disclaimer, the term of this patent is extended or adjusted under 35 U.S.C. 154(b) by 0 days.

(21) Appl. No.: 16/565,382

(22) Filed: Sep. 9, 2019

(65) Prior Publication Data

US 2020/0080269 A1 Mar. 12, 2020

Related U.S. Application Data

(60) Provisional application No. 62/728,259, filed on Sep. 7, 2018.

(51) Int. Cl.
*E02B 11/00* (2006.01)

(52) U.S. Cl.
CPC ..... *E02B 11/005* (2013.01)

(58) Field of Classification Search
CPC ..... E02B 11/005
See application file for complete search history.

(56) References Cited

U.S. PATENT DOCUMENTS 770,019 A * 9/1904 Neireiter ..... B01D 29/19 210/459
902,104 A * 10/1908 Neireiter ..... B01D 29/111 210/497.01
5,316,410 A * 5/1994 Blume ..... E02D 31/02 405/36
5,380,121 A * 1/1995 Schluter ..... E01C 11/227 404/14
5,536,420 A * 7/1996 Oyzboyd ..... C02F 3/223 210/609
5,810,509 A 9/1998 Nahlik et al.
5,908,266 A * 6/1999 Miller ..... E01C 11/227 404/2
6,077,423 A * 6/2000 Roy ..... B01D 29/15 210/121
6,746,179 B1 * 6/2004 Kerkhoff ..... A01K 1/0103 405/45
7,264,418 B1 * 9/2007 Houck ..... E01C 11/227 405/43
7,473,373 B1 * 1/2009 Danler ..... E03F 1/00 210/162

(Continued)

FOREIGN PATENT DOCUMENTS

GB 511677 8/1939
GB 1201854 8/1970

*Primary Examiner* — Benjamin F Fiorello
(74) *Attorney, Agent, or Firm* — Law Office of Mark Brown, LLC; Mark E. Brown

(57) ABSTRACT

A field drainage system includes mainline pipes or trunks, which are placed in trenches. Riser assemblies are mounted on the mainline pipes with saddles. The saddles include saddle bases placed on top of the mainline pipe and saddle inlet couplings which communicate with upwardly-open openings in the mainline pipe. The riser assemblies include transitions, which connect to the saddle inlet couplings, and riser extensions which extend upwardly from the riser assembly transitions. The riser transitions can be inverted for measuring cut off lengths of the riser transitions, using the field surface as a guide. Multiple apertures are formed in the riser extension for admitting groundwater for drainage.

20 Claims, 6 Drawing Sheets

(56) References Cited

U.S. PATENT DOCUMENTS

| | | | | |
|---|---|---|---|---|
| 9,045,874 | B1 | 6/2015 | Kondas | |
| 2005/0100412 | A1* | 5/2005 | Houck | E03F 3/046 405/124 |
| 2006/0088382 | A1* | 4/2006 | Nelson | E02B 11/00 405/41 |
| 2011/0064521 | A1* | 3/2011 | Schafer | A01G 29/00 405/41 |
| 2011/0174378 | A1* | 7/2011 | Leung | E01F 5/00 137/1 |

* cited by examiner

FIELD DRAINAGE SYSTEM AND METHOD

CROSS-REFERENCE TO RELATED APPLICATION

This application claims priority in U.S. Provisional Patent Application No. 62/728,259, filed Sep. 7, 2018, which is incorporated herein by reference.

BACKGROUND OF THE INVENTION

1. Field of the Invention

The present invention relates generally to field drainage systems and methods, and in particular to a drainage network including subsurface trunk lines fed by risers extending above grade.

2. Description of the Related Art

Agricultural fields and other areas benefit from effective drainage. For example, topsoil conservation is important in many areas. Uncontrolled drainage can cause erosion problems and loss of topsoil, which is important to the productivity of agricultural operations. Such systems should accommodate a variety of field topographies and be easily adaptable with drainage lines (e.g., trunks) that can be installed at different depths below grade.

Heretofore there has not been available a field drainage system or method with the advantages and features of the present invention.

BRIEF SUMMARY OF THE INVENTION

The present invention generally provides a system and method for effectively draining agricultural and other fields, which can efficiently be installed and accommodate a variety of field topographies.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
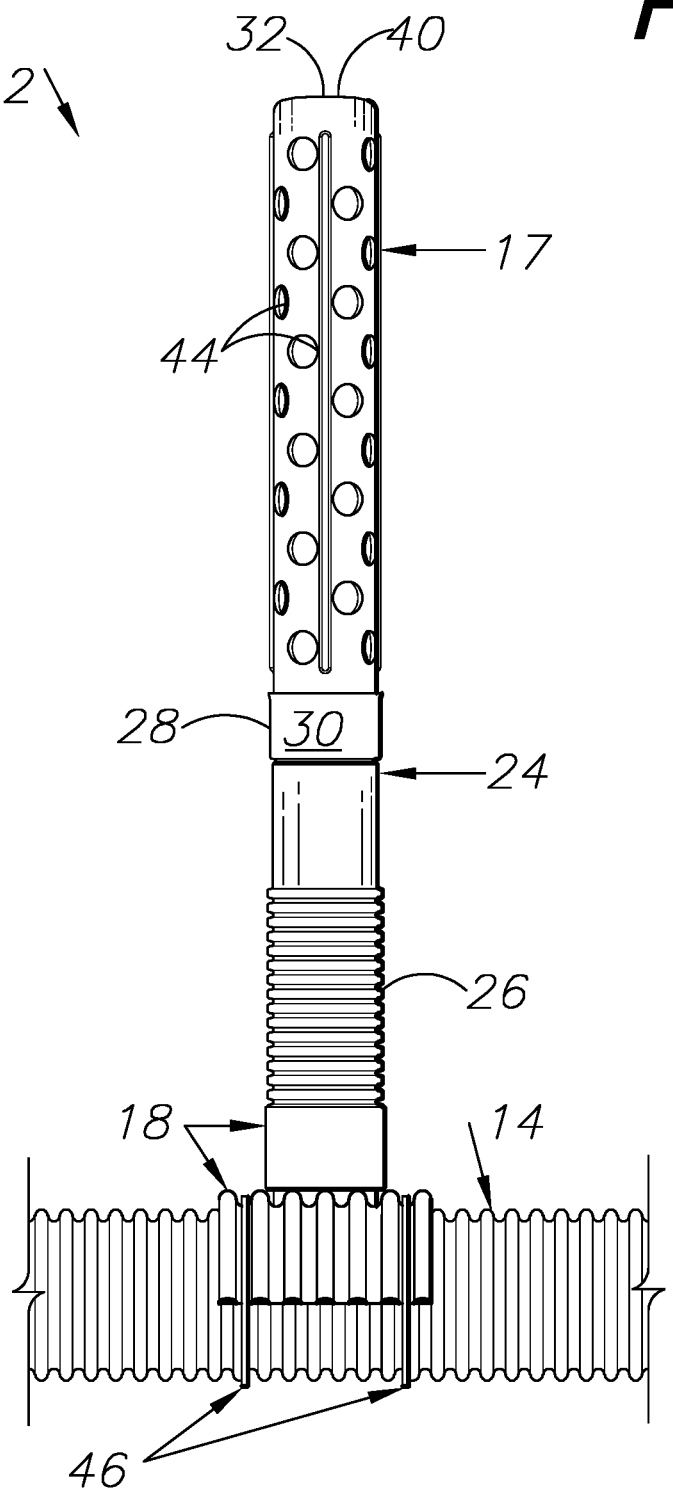
FIG. 1 is a side elevational view of a field drainage system embodying an aspect or embodiment of the present invention.
Figure 2:
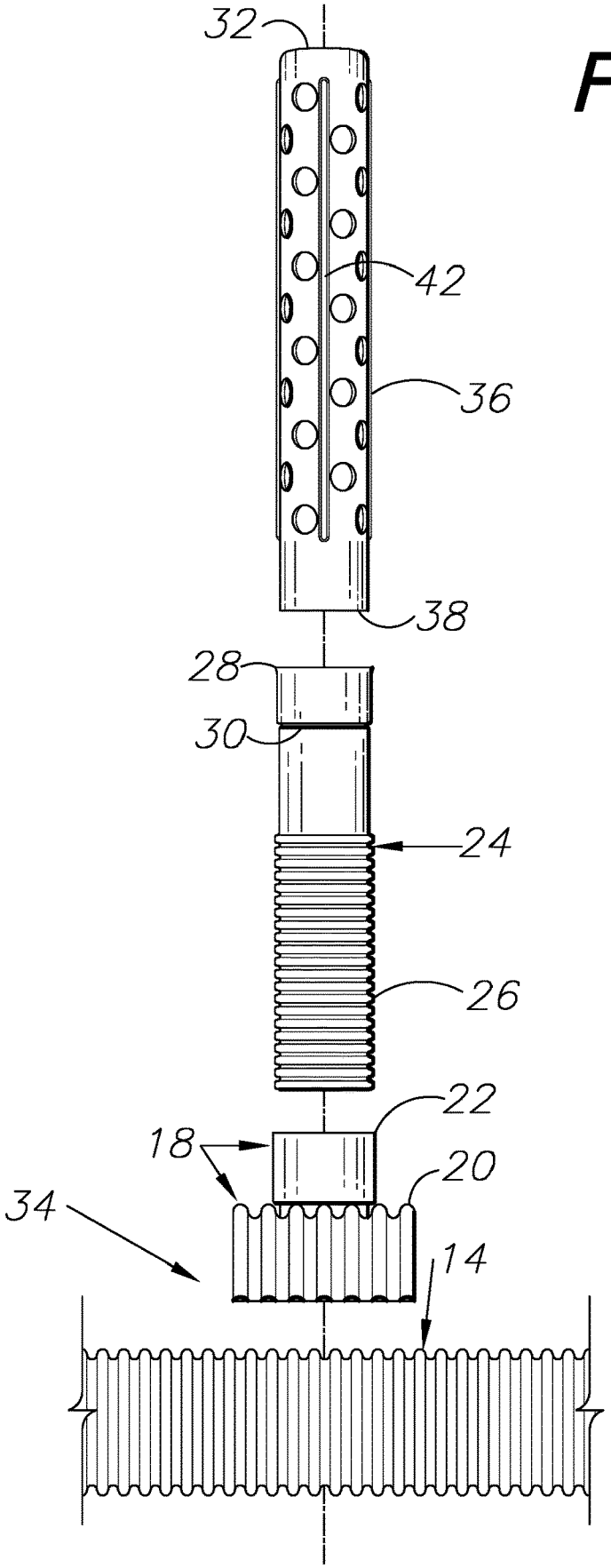
FIG. 2 is an exploded, side elevational view of the field drainage system.
Figure 3:
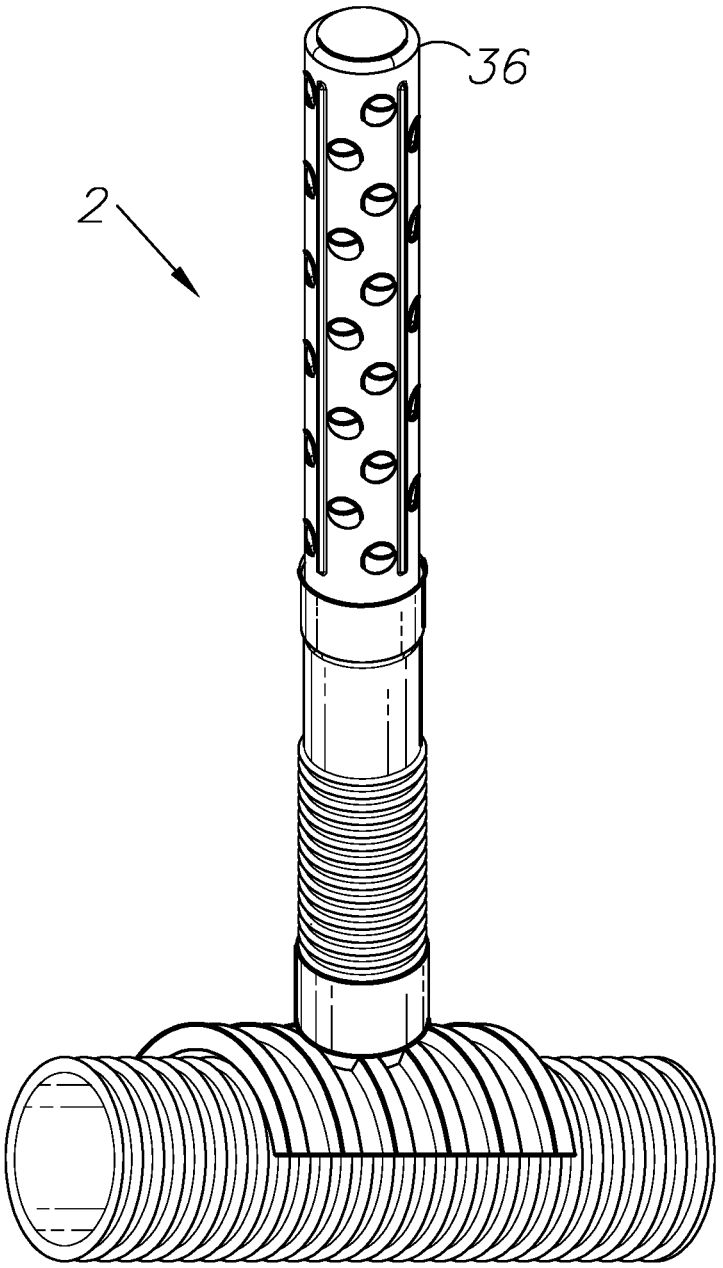
FIG. 3 is a perspective of a portion of the field drainage system.
Figure 4:
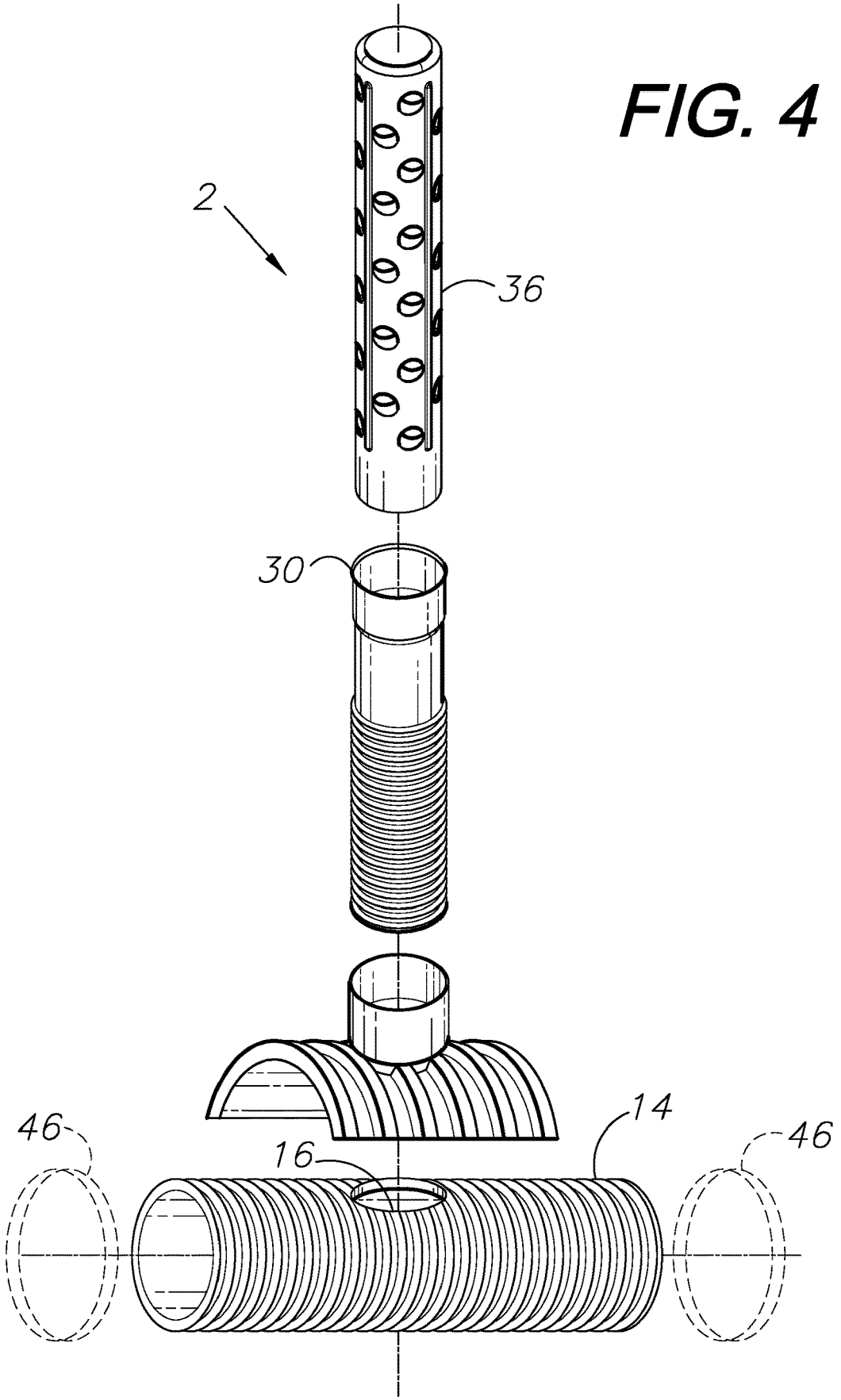
FIG. 4 is an exploded, perspective view of the field drainage system.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment

As shown in the drawings, a field drainage system 2 embodying an aspect of the present invention can be installed in fields 12 and other areas requiring surface water and runoff drainage. Main lines or trunks 14 are laid in excavated trenches at an appropriate depth. The main lines 14 include openings 16 located at spaced intervals and oriented upwardly.

A respective riser assembly 17 is placed over and communicates with each trunk opening 16. Each riser assembly 17 includes a saddle 18 with an arcuate saddle base 20 and a coupling 22 extending downwardly through the base 20 and extending upwardly from the saddle base 20. The coupling 22 defines an inside diameter. A riser extension 24 of the riser assembly 17 includes a lower, corrugated subsection 26 and an upper, smooth-walled subsection 28, which includes an annular, inwardly-extending stop 30 spaced slightly below an upper end 32 of the riser extension 17. A lower end 34 of the riser extension 17 is telescopically received in the saddle coupling 22.

The riser assembly 17 further includes a riser extension 36 with an open, lower end 38 received in the saddle inlet coupling 22 and a closed, upper end 40. Vertical ribs 42 extend longitudinally along the riser extension 36 between its ends 38, 40 and facilitate sloughing trash and other debris. Moreover, the vertical ribs strengthen the riser extensions 36. Water is admitted into the riser extension 36 through openings 44. Each opening 44 is preferably about two inches in diameter, which allows relatively small debris objects to flow into the riser extension 36, and blocks larger objects, such as plant stalks and other field debris (i.e., "field trash"). The riser extension is preferably designed to minimize trash wraparound, which could interfere with field drainage.

When the system is installed, the riser extension 24 can be inverted (FIG. 5) and the grade level can be used to determine the excess length of riser extension 24 to cut off. For final installation the riser extension 24 is placed right-side-up (FIG. 6) and its corrugated, lower end 34 is received in the saddle inlet coupling 22.

Figure 5:
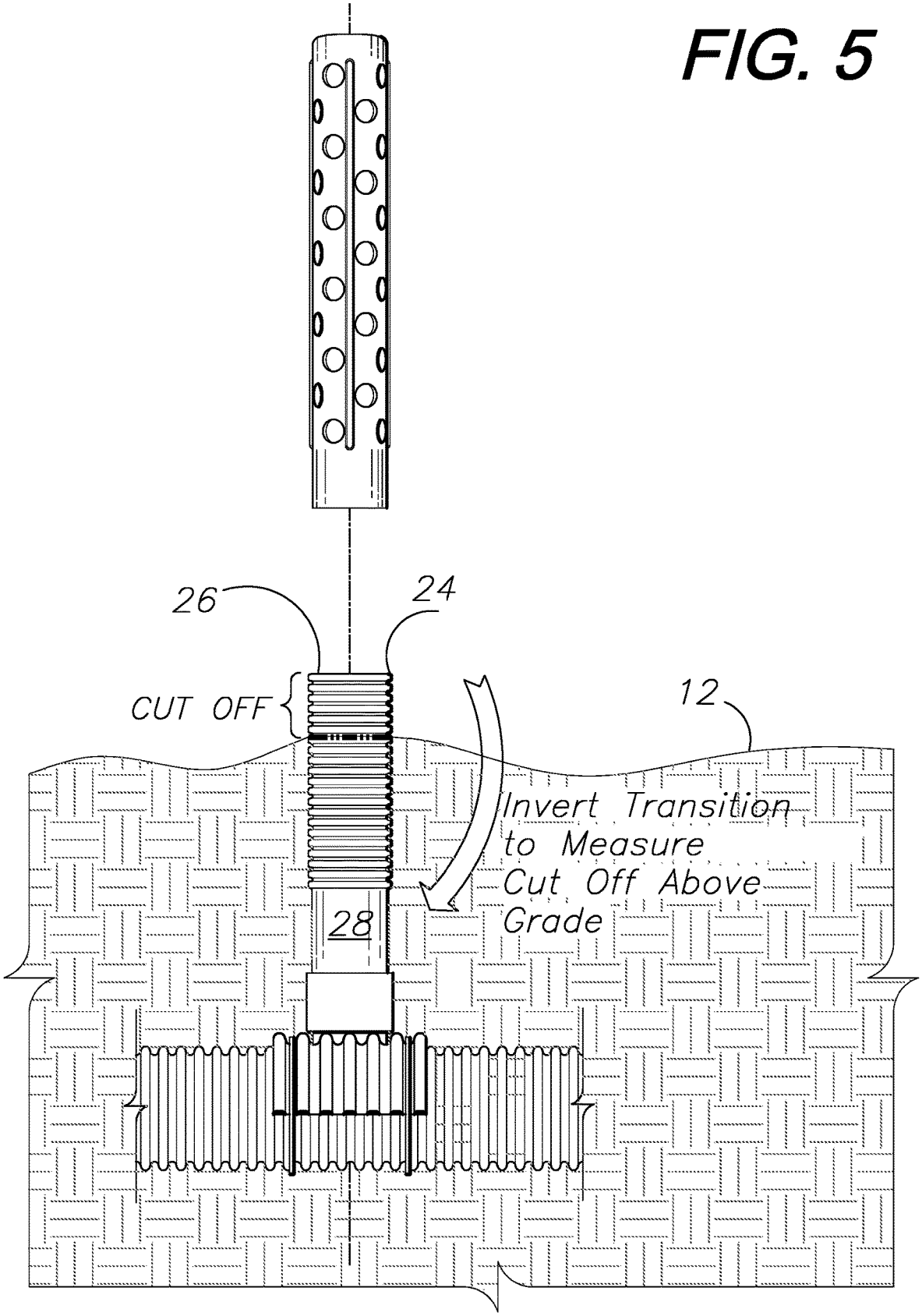
FIG. 5 shows the field drainage system installed with a riser extension inverted for measuring a cut-off location to remove excess length.
Figure 6:
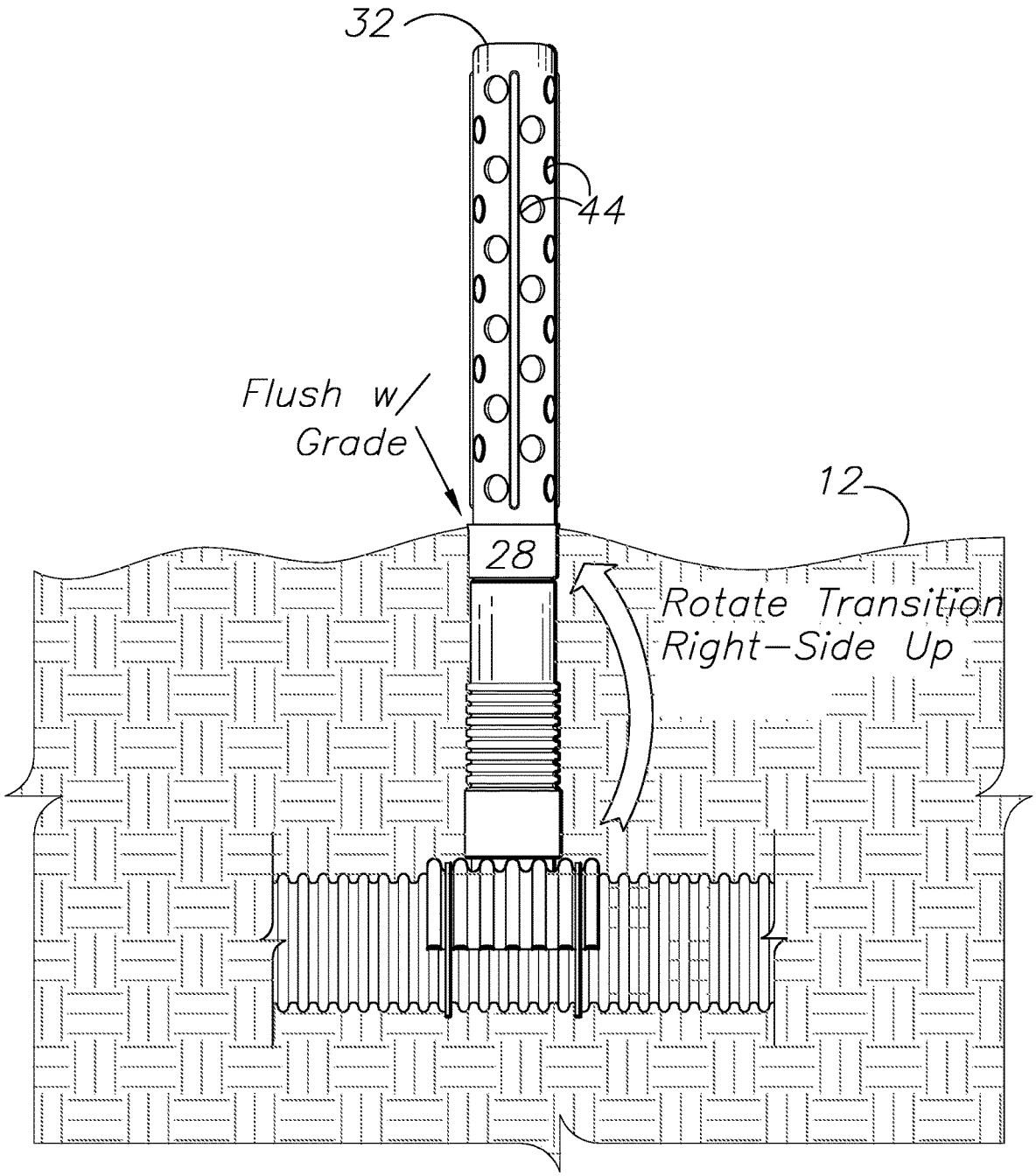
FIG. 6 shows the field drainage system with the riser extension right-side-up.

The saddle 18 can optionally be secured to the trunk line 14 by an encircling connector 46 (FIGS. 1, 5, 6). Without limitation, the encircling connector 46 can comprise a hose clamp or a twist tie. Alternatively, the saddle 18 can be secured to the trunk line 14 by fasteners, such as screws, wires and other fasteners.

The components of the field drainage system can be installed in various configurations to accommodate field conditions. For example, the pipe section diameters can vary based on anticipated drainage flow, field trash and other variables. Depending on the depth of the main line (trunk) 14, one or more additional riser extension(s) 24 can be installed. For example, with the main or trunk line 14 buried relatively deeply below grade 12, such an extended riser extension (or sections) 24 of dual-wall pipe may be needed to elevate the riser extension 36 to a proper elevation above finished grade 12. The riser extensions 24 can comprise dual-wall corrugated pipe, similar to the lower subsection 26 of the riser extension 24. Fields 12 can be provided with multiple trunks 14, each receiving runoff and standing water from multiple riser assemblies 17. Networks of such drainage system components can be placed for gravity drainage. For example, the trunks 14 can drain to natural watercourses, ponds, lakes, streams, rivers, etc., or to lower-elevation areas for additional draining, surface application, pumping, etc.

The drainage system 2 is usable in both tillage and no-till applications, and in terraced and non-terraced fields. The components of the system 2 can comprise any suitable material, such as high-density polyethylene (HDPE) plastic.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A field drainage system comprising:
- a subsurface mainline drainage pipe with an upwardly-open inlet opening;
- a riser assembly including:
  - a saddle including a saddle base overlying said mainline pipe and a saddle inlet coupling extending upwardly from said saddle base and opening into said mainline pipe inlet opening;
  - a riser transition including:
    - a riser transition lower subsection with a lower, open end;
    - a riser transition upper subsection with an open, upper end;
  - a riser extension including:
    - and open lower end received in said transition upper subsection upper end;
    - multiple openings between said riser extension lower and upper ends; and
  - said riser extension configured for extending above grade whereby said openings are exposed for receiving field drainage.

2. The field drainage system according to claim 1 wherein said mainline drainage pipe comprises corrugated pipe.

3. The field drainage system according to claim 1 wherein said saddle base comprises an arcuate section of corrugated pipe overlying said mainline drainage pipe.

4. The field drainage system according to claim 1 wherein said riser transition lower subsection comprises corrugated pipe.

5. The field drainage system according to claim 1 wherein said riser extension includes vertical ribs extending generally parallel to an axis of said riser extension and protruding outwardly from a riser extension outer surface.

6. The field drainage system according to claim 1 wherein said riser transition is configured for being cut to length to accommodate different subsurface depths of said mainline trunk.

7. The field drainage system according to claim 1 wherein said saddle base is secured on said mainline drainage pipe by an encircling connector.

8. The field drainage system according to claim 1 wherein said encircling connector comprises a hose clamp.

9. The field drainage system according to claim 1 wherein said encircling connector comprises a twist tie.

10. The field drainage system according to claim 1, which includes multiple mainline pipes buried in subsurface trenches at spaced intervals in said field, and multiple riser assemblies mounted on and draining into each mainline pipe.

11. A field drainage system comprising:
- a subsurface mainline corrugated drainage pipe with an upwardly-open inlet opening;
- a riser assembly including:
  - a corrugated pipe saddle including a saddle base comprises an arcuate section of corrugated pipe overlying said mainline drainage pipe saddle base overlying said mainline pipe and a saddle inlet coupling extending upwardly from said saddle base and opening into said mainline pipe inlet opening;
  - a riser transition including:
    - a corrugated pipe riser transition lower subsection with a lower, open end;
    - a riser transition upper subsection with an open, upper end;
  - a riser extension including:
    - and open lower end received in said transition upper subsection upper end;
    - a closed upper end;
    - multiple openings between said riser extension lower and upper ends; and vertical ribs extending generally parallel to an axis of said riser extension and protruding outwardly from a riser extension outer surface;
  - said riser extension configured for extending above grade whereby said openings are exposed for receiving field drainage;
  - said riser transition is configured for being cut to length to accommodate different subsurface depths of said mainline trunk; and
  - said saddle base being secured on said mainline drainage pipe by an encircling connector.

12. The field drainage system according to claim 11 wherein said encircling connector comprises a hose clamp.

13. The field drainage system according to claim 11 wherein said encircling connector comprises a twist tie.

14. A method of draining a field, which includes the steps of:
- providing multiple mainline pipes;
- providing each said mainline pipe with an upwardly-open inlet opening;
- burying said mainline pipes in subsurface trenches at spaced intervals in said field;
- providing multiple riser assemblies each mounted on and draining into each mainline pipe a subsurface mainline drainage pipe;
- providing each riser assembly with:
  - a saddle including a saddle base overlying said mainline pipe and a saddle inlet coupling extending upwardly from said saddle base and opening into said mainline pipe inlet opening;
  - a riser transition including:
    - a riser transition lower subsection with a lower, open end;

a riser transition upper subsection with an open, upper end;

a riser extension including: and and open lower end received in said transition upper subsection upper end;

multiple openings between said riser extension lower and upper ends; and extending each said riser extension above grade whereby said openings are exposed for receiving field drainage;

with said mainline drainpipe placed in a trench, placing said riser section upside down in said saddle inlet coupling; cutting said transition section at field grade; and inverting said transition section.

15. The field drainage method according to claim 14 wherein said mainline drainage pipe comprises corrugated pipe.

16. The field drainage method according to claim 14 wherein said saddle base comprises an arcuate section of corrugated pipe overlying said mainline drainage pipe.

17. The field drainage method according to claim 14 wherein said riser transition lower subsection comprises corrugated pipe.

18. The field drainage method according to claim 14 wherein said riser extension includes vertical ribs extending generally parallel to an axis of said riser extension and protruding outwardly from a riser extension outer surface.

19. The field drainage method according to claim 14 wherein said riser transition is configured for being cut to length to accommodate different subsurface depths of said mainline trunk.

20. The field drainage method according to claim 14, which includes the additional step of connecting said saddle base to said mainline drainage pipe.

* * * * *